US006969795B2

(12) United States Patent
Hofmeister et al.

(10) Patent No.: US 6,969,795 B2
(45) Date of Patent: Nov. 29, 2005

(54) ELECTRONIC TONE GENERATION SYSTEM AND BATONS THEREFOR

(75) Inventors: Mark R. Hofmeister, Collegeville, PA (US); Gregory L. Schwartz, Spinnerstown, PA (US)

(73) Assignee: Schulmerich Carillons, Inc., Sellersville, PA (US)

( * ) Notice: Subject to any disclaimer, the term of this patent is extended or adjusted under 35 U.S.C. 154(b) by 57 days.

(21) Appl. No.: 10/706,803

(22) Filed: Nov. 12, 2003

(65) Prior Publication Data

US 2005/0098021 A1 May 12, 2005

(51) Int. Cl.[7] ..... G10H 3/00; G10H 7/00
(52) U.S. Cl. ..... 84/600; 84/723; 84/735
(58) Field of Search ..... 84/600, 609–610, 84/615, 622, 645, 649–650, 653, 659, 723, 84/735, 742

(56) References Cited

U.S. PATENT DOCUMENTS 5,585,584 A * 12/1996 Usa ..... 84/600
5,648,627 A * 7/1997 Usa ..... 84/600
6,018,118 A * 1/2000 Smith et al. ..... 84/600
6,198,034 B1 * 3/2001 Beach et al. ..... 84/600
2001/0015123 A1 * 8/2001 Nishitani et al. ..... 84/615
2002/0166437 A1 * 11/2002 Nishitani et al. ..... 84/600
2002/0170413 A1 * 11/2002 Nishitani et al. ..... 84/600
2003/0230186 A1 * 12/2003 Ishida et al. ..... 84/737
2004/0079220 A1 * 4/2004 Yagi ..... 84/484

OTHER PUBLICATIONS

Schulmerich Handbells, MelodyChime® Instruments, & Accessories 2002, 6 page brochure, Jun. 2002.

* cited by examiner

*Primary Examiner*—Marlon Fletcher
(74) *Attorney, Agent, or Firm*—Howson and Howson

(57) ABSTRACT

An electronic tone generation system including a plurality of separate, portable, handheld transmitters, or batons, that are provided as "instruments" to numerous players to form a choir. Each baton is activated by one of the players to send a signal, preferably a wireless signal, to a single receiver which produces an output signal fed to a tone generator, preferably a MIDI tone generator, which produces audible sounds via an amplifier and speakers. For example, the batons can correspond to different musical notes as played by a selected musical instrument and the batons can be played in concert by the choir to produce a musical or other audible presentation. Alternatively, selected batons can be designated to play in one voice, while others batons are set to play other voices.

28 Claims, 10 Drawing Sheets

ELECTRONIC TONE GENERATION SYSTEM AND BATONS THEREFOR

FIELD OF THE INVENTION

The present invention relates to an electronic tone generation system in which multiple, separate wireless transmitters, or batons, are utilized in association with a receiver and tone generator to produce audible sounds, and more particularly, the present invention relates to a handheld baton that has a sensor for sensing movement of the baton to cause signals to be transmitted to the receiver.

BACKGROUND OF THE INVENTION

U.S. Pat. No. 6,198,034 B1 issued to Beach et al. and assigned to Schulmerich Carillons Inc., the assignee of the present application, discloses an electronic tone generation system in which instruments in the form of portable handheld wireless transmitters are provided to a number of players to form a choir. Activation of the transmitters by the players send signals to a single receiver that communicates with a single tone generator to produce audible sounds. Thus, the players functioning in concert can produce a musical presentation.

One embodiment of a handheld wireless transmitter, or baton, disclosed by the Beach patent has an inertia switch configured to cause the transmitter to transmit upon rapid movement of the transmitter by the player. Thus, the batons and system can be used by a group to produce music in a fashion similar to that of a handbell choir.

Although the electronic tone generation system and handheld wireless transmitters (ie., batons) disclosed in the above cited patent may function satisfactorily for their intended purposes, there remains a need for an improved baton and electronic tone generation system. For example, the batons should be prevented from transmitting signals as a result of incidental movement of the baton, and the sensors, or inertia switches, used in the batons should provide silent operation and be safe for use in the intended environment. For instance, the switches should not contain dangerous substances, such as mercury, or produce clicking noises when operated, such as produced by mechanical tilt or ball switches and the like. In addition, communication should occur between the batons and the receiver in a manner providing quick response times and without interference. Further, other improvements should be provided so that the system is reliable and user-friendly and permits numerous options with respect to voice selection, volume, pre-set storage and recall of various parameters, battery recharging, and the like.

OBJECTS OF THE INVENTION

With the foregoing in mind, a primary object of the present invention is to provide a "smart" baton for an electronic tone generation system that provides improvements with respect to the electronics and operation of the baton.

Another object of the present invention is to provide an electronic tone generation system that is reliable, user-friendly and provides numerous options with respect to its setup and operation.

SUMMARY OF THE INVENTION

More specifically, the present invention provides a baton for use in cooperation with an electronic tone generation system to produce different audible sounds in response to different movements of the baton. The baton has a housing with an end portion grippable by a user's hand for movement in a plane between at least a first free position and a second surface engaging position. A motion sensor is carried in the housing a spaced distance from the end portion for producing an electromagnetic signal in response to movement of the baton. A signal processor is carried in the housing and cooperates with the motion sensor to produce a transmittable play signal when movement of the baton is to the first position and a transmittable mute signal when movement of the baton is to the second position. Thus, the user can produce either full or muted sounds by moving the baton between the first and second positions.

According to another aspect of the present invention, the motion sensor of the baton generates waveforms of different shapes depending upon baton orientation and its direction of movement. The signal processor causes an electromagnetic signal to be transmitted from the baton to cause the system to produce an audible sound only when the signal processor receives a waveform from the motion sensor that is within a predetermined range of waveform shapes.

According to another aspect of the present invention, an electronic tone generation system is provided. The system includes a plurality of separate handheld batons each capable of wireless communication with a receiver that generates an output signal. The batons each have a housing with a grippable end portion, and a motion sensor carried in the housing a spaced distance from the end portion. The motion sensor generates an electromagnetic waveform signal having alternating polarity in response to movements of the baton, and the motion sensor generates different waveforms depending upon baton orientation and direction of movement. The batons each have a signal processor and transmitter carried in the housing for selectively effecting wireless transmission to the receiver to produce an audible sound only when a section of the electromagnetic waveform signal generated by the motion sensor has a predetermined polarity and extends above a threshold value for at least a predetermined period of time.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
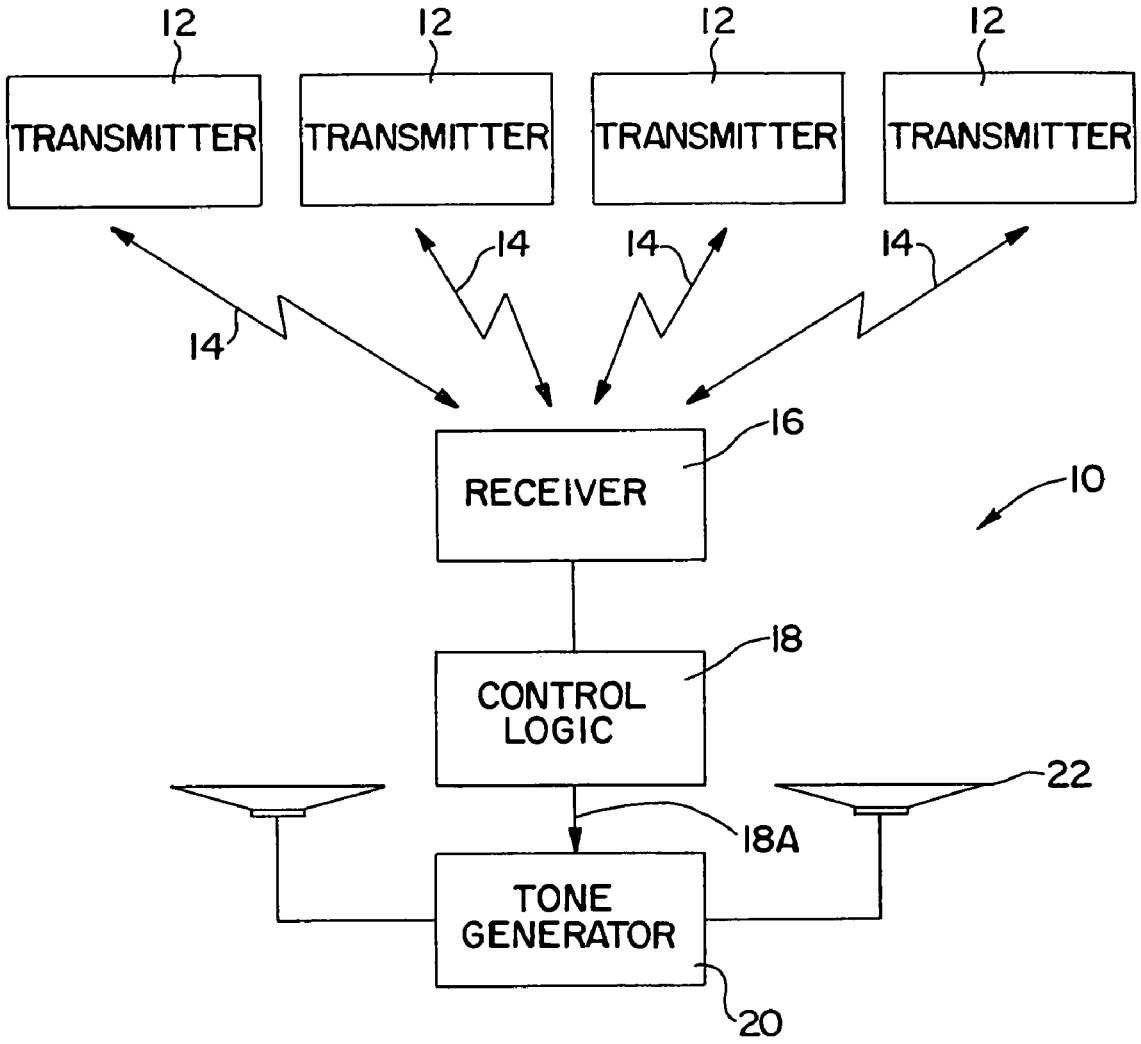
FIG. 1 is a block diagram of an electronic tone generating system according to the present invention.

Referring now to the drawings, an electronic tone generation system 10 according to the present invention is illustrated schematically in FIG. 1. To this end, the system 10 includes a plurality of separate, portable, handheld transmitters, or batons, 12 that are provided as "instruments" to numerous players to form a choir. Each baton 12 can be activated by one of the players to send a signal, preferably a wireless signal, 14 to a single receiver 16 causing control logic 18 to produce an output signal 18A. The output signal is fed to a tone generator 20 to produce audible sounds via an amplifier and speakers 22. For example, each baton 12 can correspond to a different predetermined musical note of a selected musical instrument or the like, and the batons 12 can be played in concert by the choir to produce a musical or other audible presentation. Such a system is described in U.S. Pat. No. 6,198,034 B1 issued to Beach et al., the disclosure of which is incorporated herein by reference.

Figure 2:
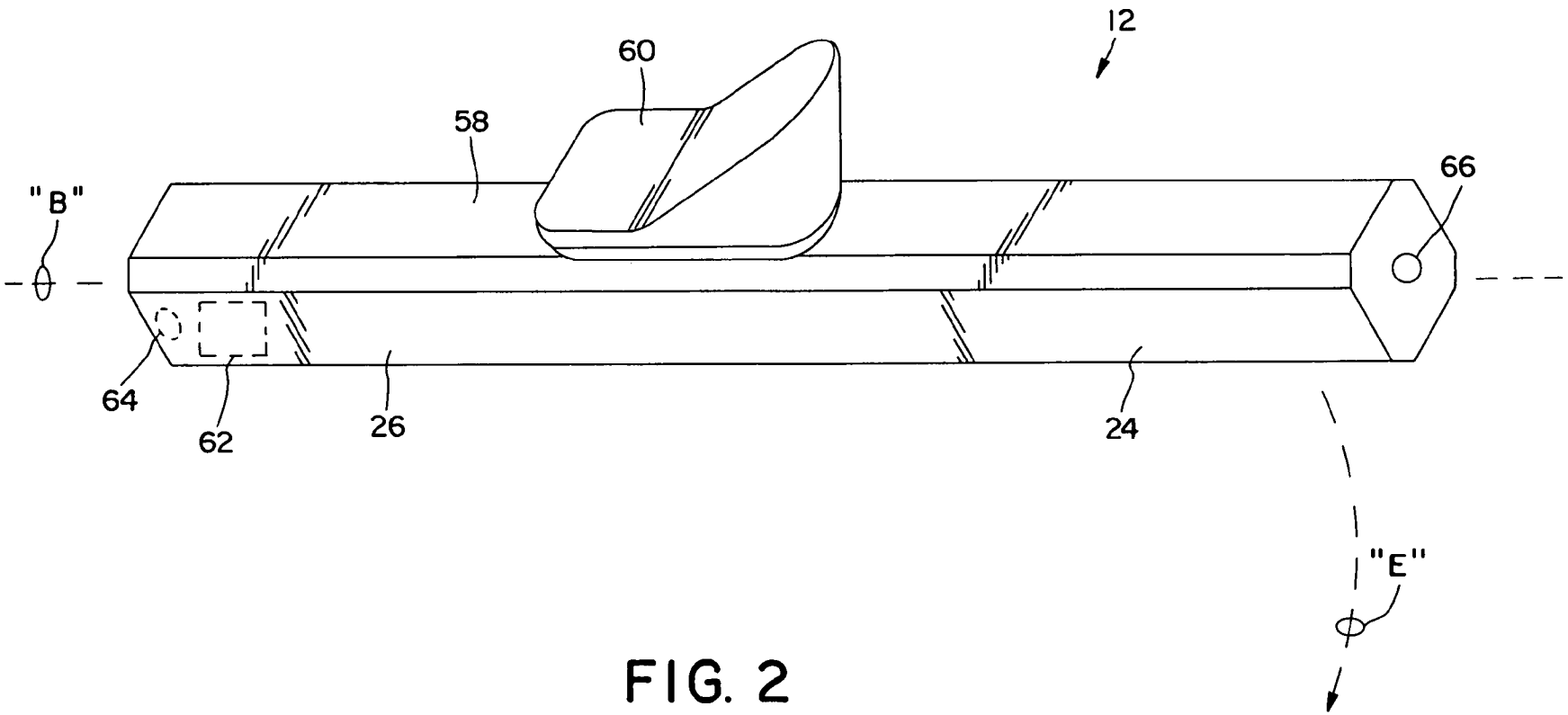
FIG. 2 is a perspective view of a baton according to the present invention.

The term transmitter and the term baton are used interchangeably and are both referred to as being a handheld instrument 12. An example of a baton 12 is illustrated in FIG. 2 and has an elongate housing 24 with an end portion 26 that is grippable by a hand of a player, or user. The shape of the baton 12 and/or housing 24 is a matter of design choice, and any configuration can be utilized and will be defined herein as a baton.

Figure 3:
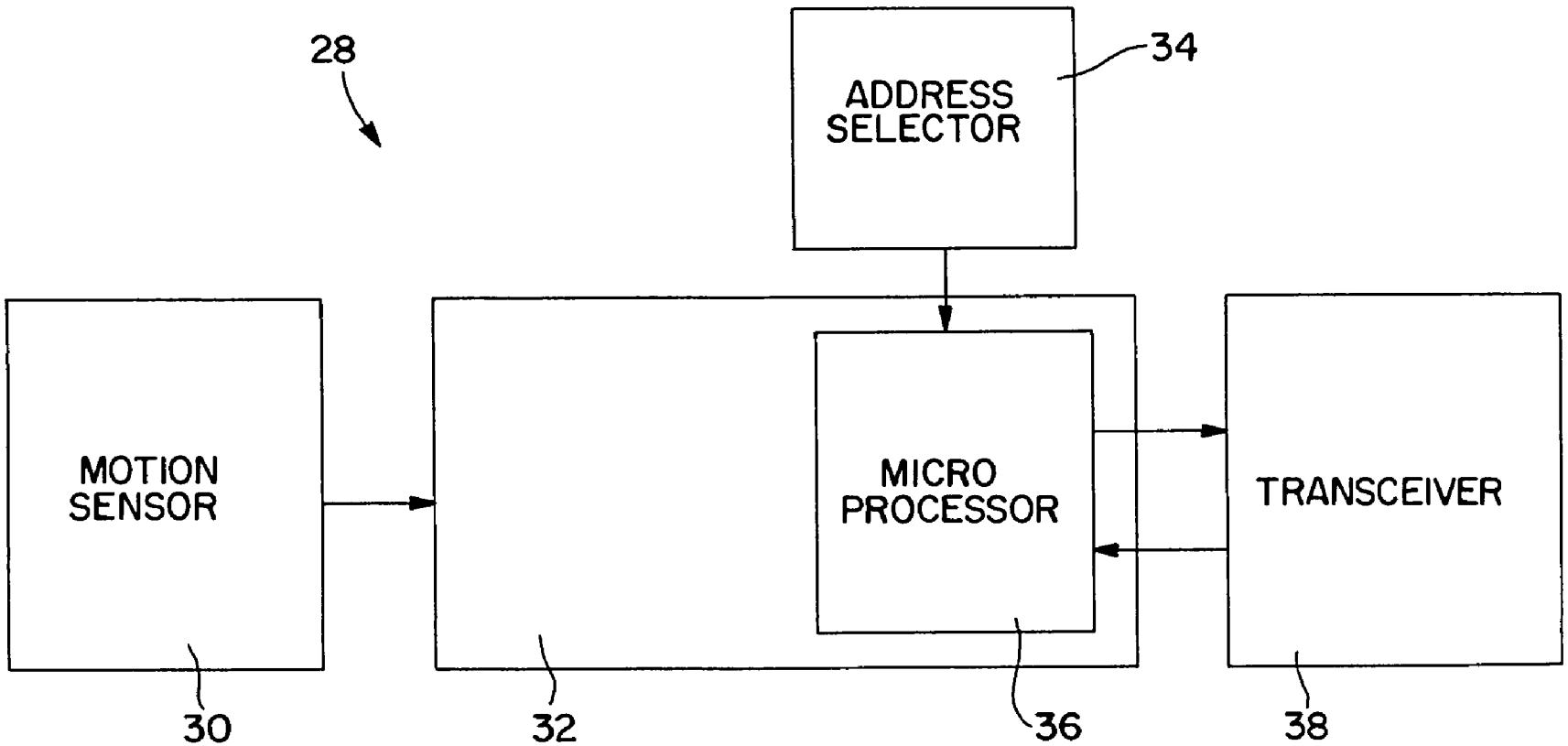
FIG. 3 is a block diagram of the electronics within a baton according to the present invention.

One of the novel aspects of the present invention is the electronics 28 within the baton 12 as shown schematically in FIG. 3. A motion sensor 30 is carried within the housing 24 a spaced distance from the end portion 26 and produces an electromagnetic signal, such as an electromagnetic waveform signal, in response to movements of the baton 12. A signal processor 32 carried in the housing 24 determines from the waveform whether or not a signal should be transmitted by the baton 12 and the type of signal to be transmitted. For example, the signal processor 32 may determine that, in response to a waveform generated by the motion sensor 30, a signal should be transmitted by the baton 12 to cause an audible sound to be produced by the tone generator 20 at a relative volume level and/or intensity. Alternatively, the signal processor 32 may determine that movement of the baton 12 was incidental and that no signal should be transmitted, or may determine that a signal should be transmitted by the baton 12 to quench, or mute, a tone currently being generated by the tone generator 20. Preferably the signal processor 32 includes circuitry for analyzing the waveform and a microprocessor 36 for controlling when a transceiver, or transmitter, 38 transmits a particular signal to the receiver 16.

Figure 4:
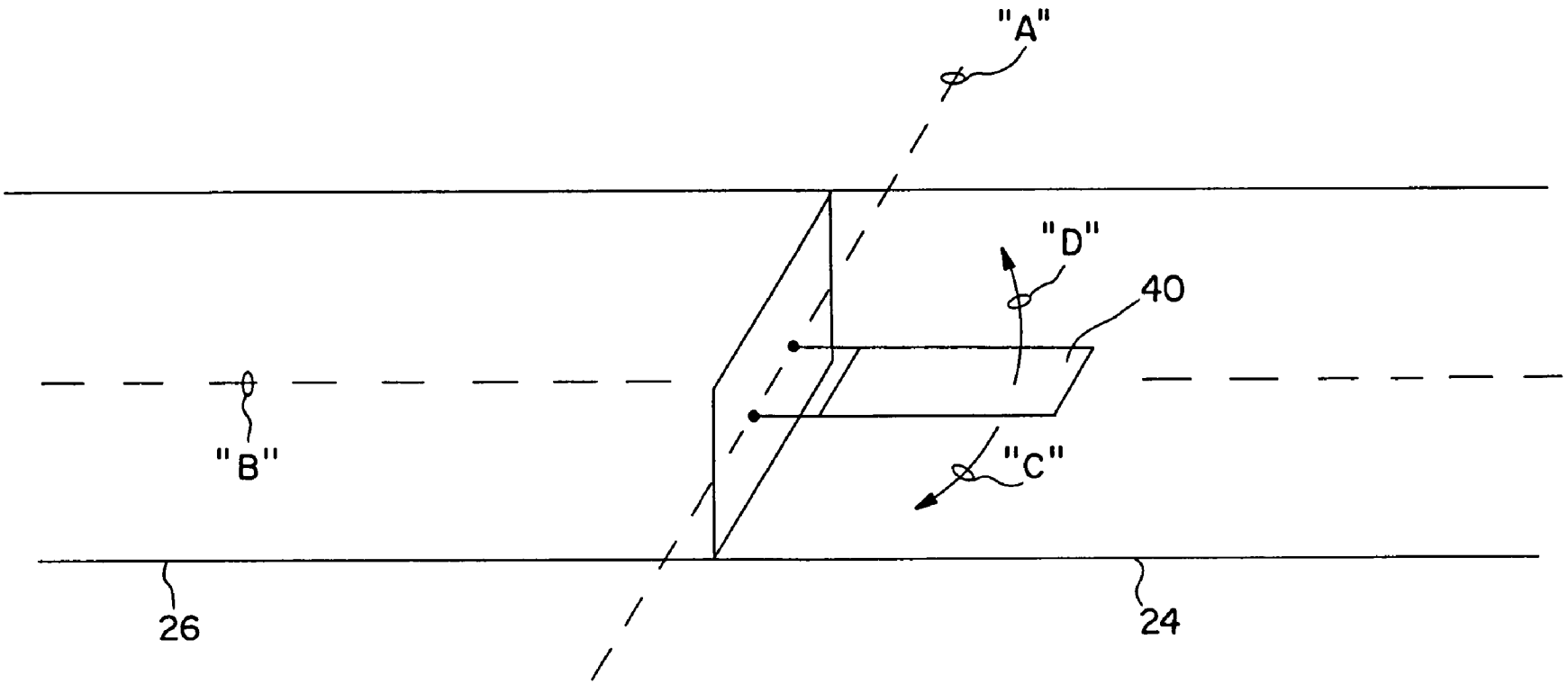
FIG. 4 is a perspective view of a motion sensor according to the present invention.

As illustrated in FIG. 4, a preferred motion sensor 30 according to the present invention is a piezoelectric film, or reed, 40 or like electronic component. Such a component is silent in operation and does not contain any potentially harmful substances, such as mercury. The piezoelectric film 40 is mounted in the housing 24 such that it is able to flex about an axis "A" that is transverse, preferably perpendicular, to a longitudinal axis "B" of the elongate housing 24. Forward and rearward flexural movement of the reed 40 is illustrated by arrows "C" and "D" in FIG. 4. The piezoelectric film 40 produces a voltage when flexed, and the voltage has a polarity depending on whether the film 40 is flexing in a forward or rearward direction. When the baton 12 is moved, the film 40 flexes and the shape of the waveform produced by the film 40 can be used to determine whether or not to transmit a signal as well as the type of signal to transmit.

An advantage provided by the reed 40 is that its flexure, and thus the waveform produced, is a function of the direction and orientation of baton movement as well as the extent and strength of the movement and whether or not a surface is engaged or contacted. For example, movement of the baton in a plane transverse, preferably perpendicular, of axis "A" causes the reed to bend in a significant manner and then quickly oscillate to an initial neutral position. Such movement will produce an alternating, or oscillating, waveform of a particular shape having sections of a specific polarity that can readily be identified by the signal processor 32. Alternatively, if the movement of the baton is incidental, for instance, along a plane substantially parallel to axis "A", or of relatively insignificant duration, velocity or acceleration, the flexure of the reed 40, if any, will produce a waveform significantly different to that discussed above. Further, when the baton is brought into engagement or contact with a surface, yet another identifiable waveform is generated. Specific examples are provided below.

Figure 5:
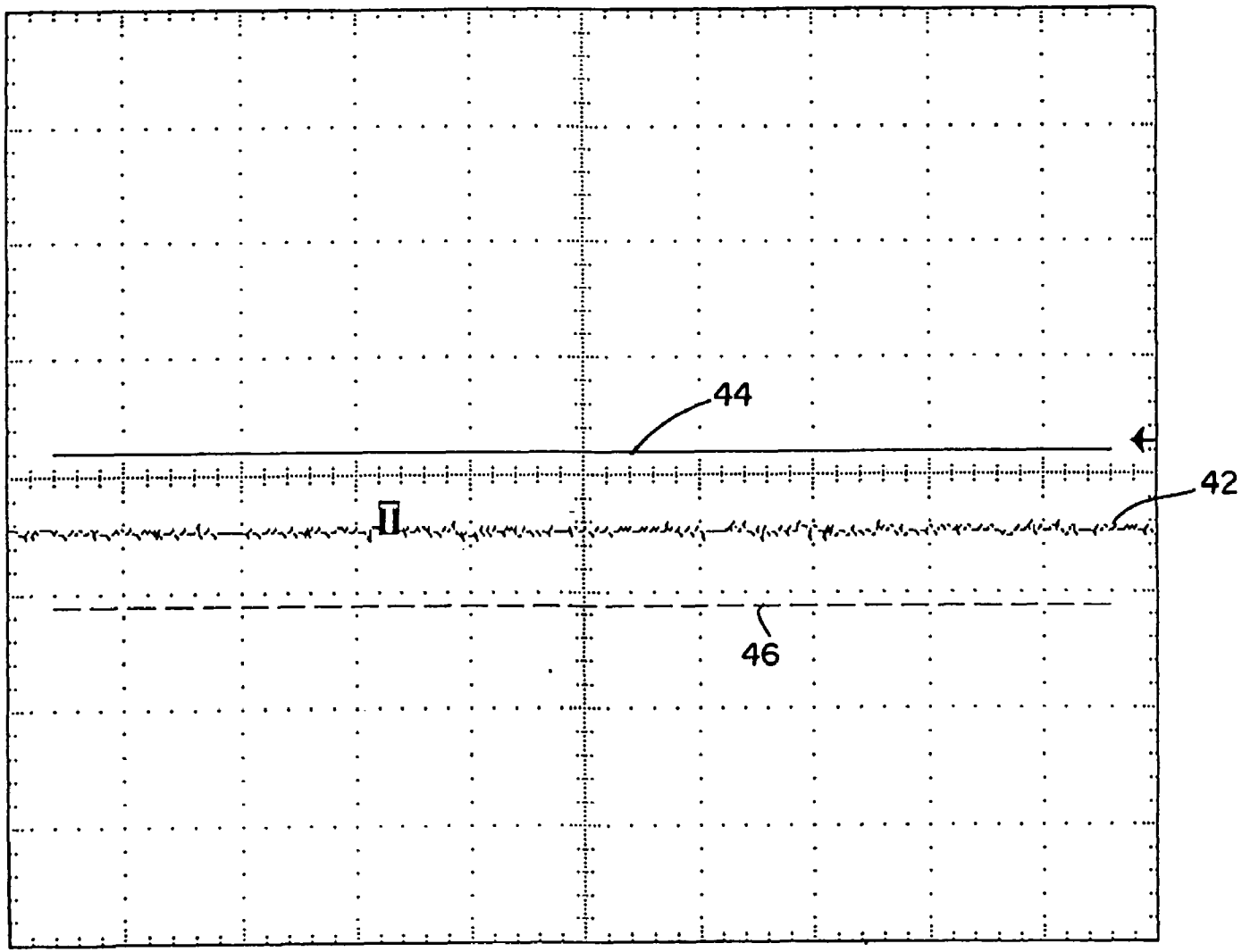
FIGS. 5–10 are traces of waveform signals generated by the motion sensor in response to various motions of the baton according to the present invention.

FIG. 5 illustrates a waveform 42 in which the baton 12 is motionless and the signal generated by the reed 40 is of regular bias. For FIGS. 5–10, the x-axis of the graphs corresponds to milliseconds, the y-axis corresponds to millivolts, the solid line 44 represents an upper, or positive, minimum threshold value, and the dashed line 46 represents a lower, or negative, minimum threshold value. The signal processor 32 of the baton 12 may cause a signal to be transmitted by the baton 12, for instance, when a section of the waveform extends beyond one of the thresholds, 44 and 46, for greater than a minimum period of time, or less than a maximum period of time, depending on the type of signal to be sent. In FIG. 5, no part of the waveform 42 extends beyond either threshold, 44 and 46, and thus, no transmission is sent by the baton 12.

Figure 6:
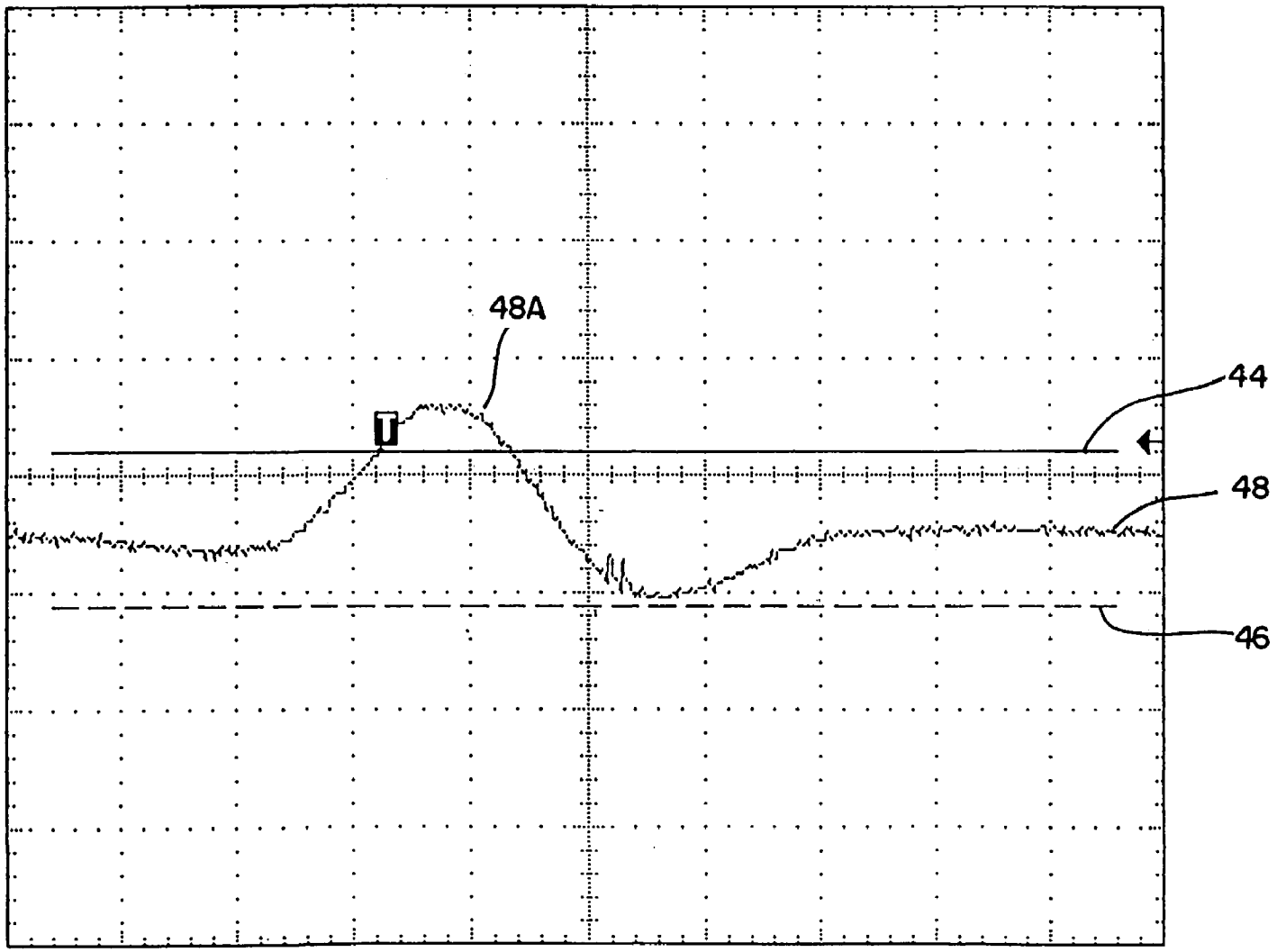
Figure 7:
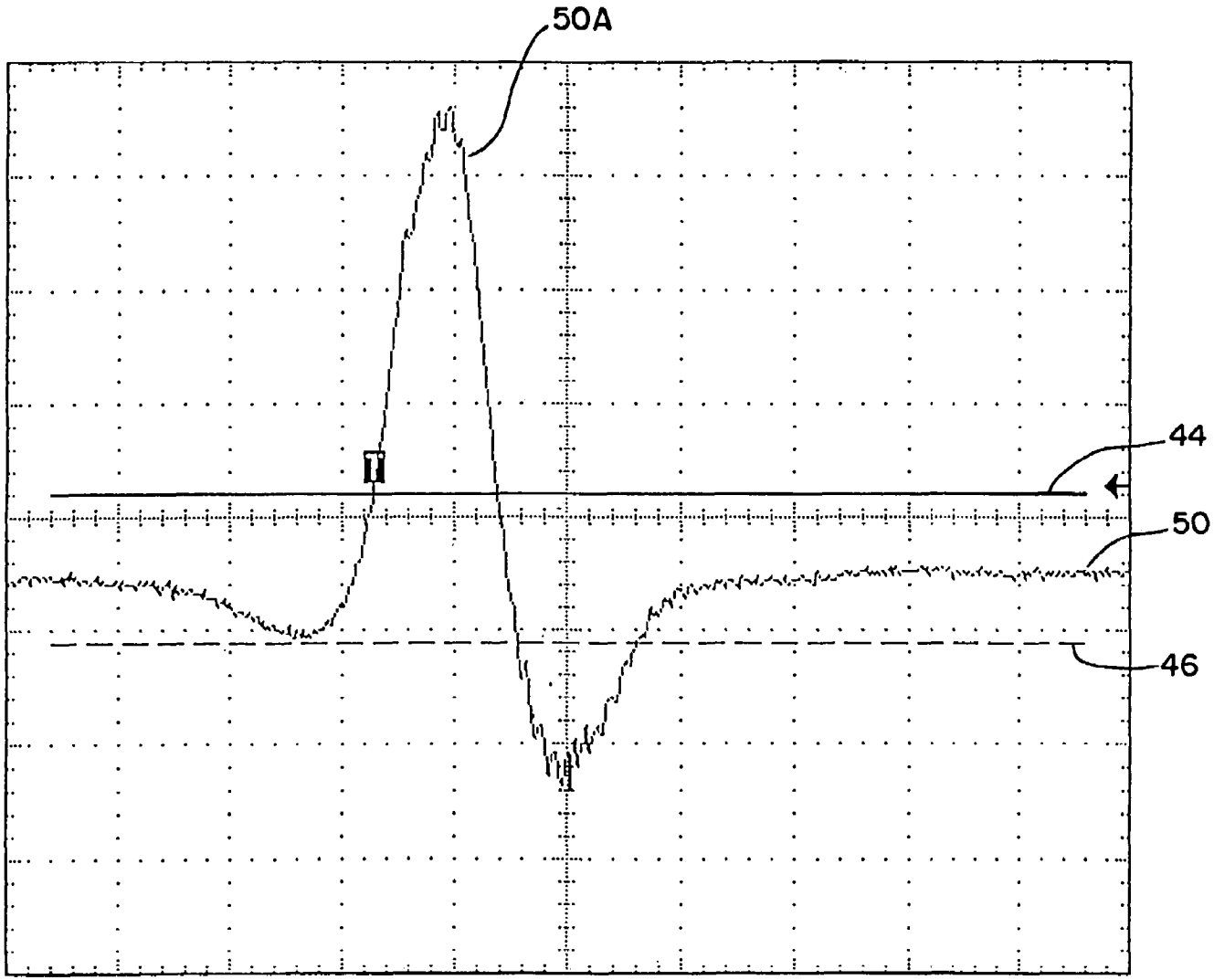

FIG. 6 illustrates a waveform 48 that is generated during a relatively soft forward thrusting movement of the baton 12 in a plane transverse, preferably perpendicular, to axis "A" about which the reed 40 flexes. This corresponds to an intended playing motion of the baton 12 and is accomplished when the player desires an audible sound to be produced in response to the movement. For example, a play signal is transmitted by the baton 12 when the user grips end portion 26 of the baton 12 and rapidly moves the baton in a plane of movement as indicated by arrow "E" in FIG. 2 to a first free position. FIG. 7 illustrates a waveform 50 similar to waveform 48, except that the thrusting movement that produced waveform 50 was significantly stronger and produced a waveform having a greater amplitude.

The signal processor 32 can be set, for instance, to cause a signal to be sent from the baton 12 to the receiver 16 to play an audible sound when a section of the waveform extends beyond the minimum threshold 44 for greater than a predetermined period of time, such as approximately 35 milliseconds. The waveforms, 48 and 50 of FIGS. 6 and 7 both have a section, 48A and 50A, that extends beyond the minimum threshold 44 for greater than 35 milliseconds; thus, both waveforms 48 and 50 cause a play signal to be sent from the baton 12. The amplitude of the sections 48A and 50A is utilized to determine a relative volume level, or intensity, of the audible sound to be produced. In this instance, the section 50A of waveform 50 of FIG. 7 has a greater amplitude and will result in a louder audible sound being produced relative to the sound produced in response to waveform 48 shown in FIG. 6.

Figure 8:
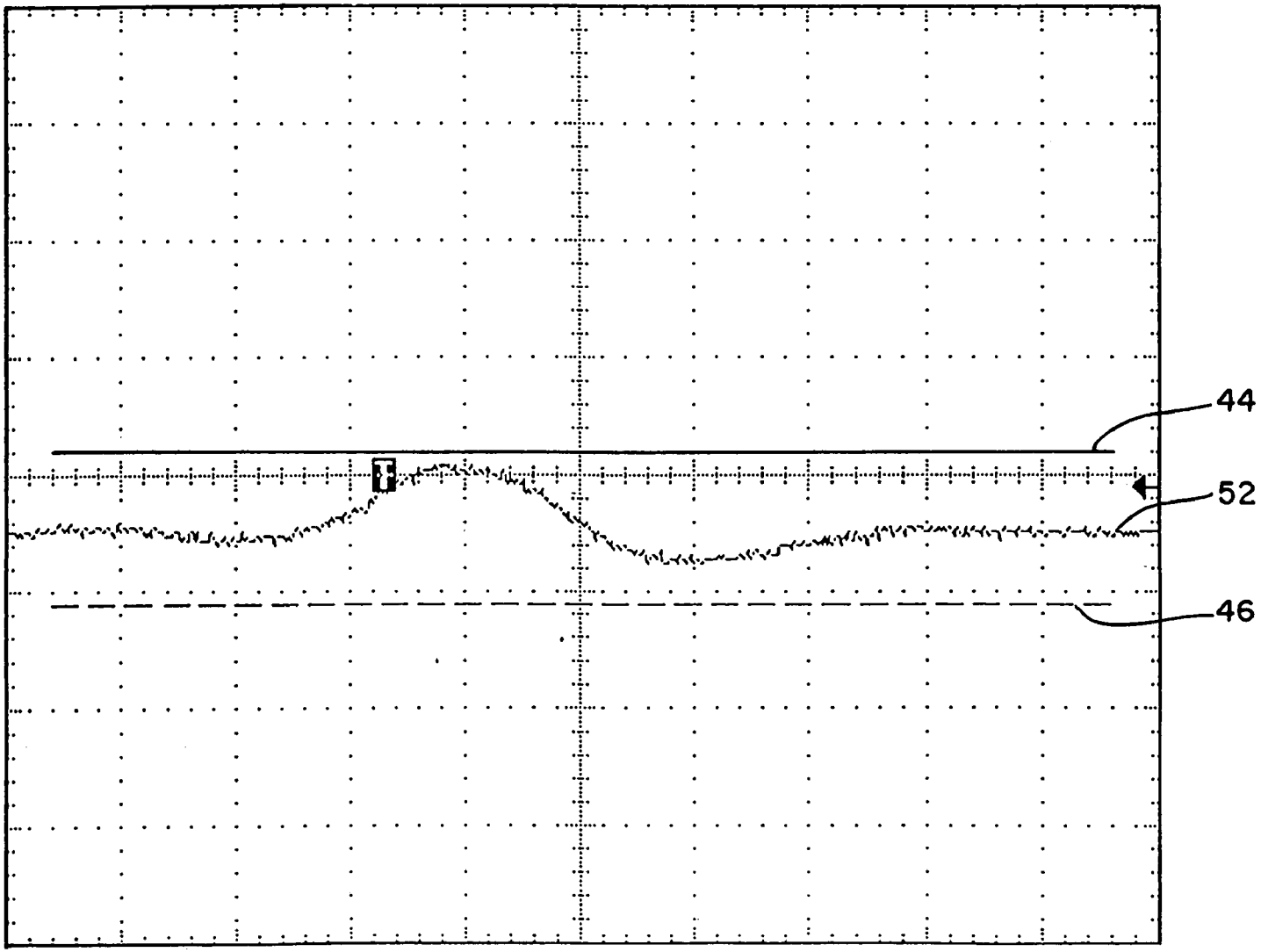

FIG. 8 illustrates a waveform 52 that is generated during a movement of the baton 12 that is too weak to produce a waveform that extends beyond the minimum thresholds 44 and 46. Such movement is typically the result of incidental baton movement when a sound is not intended to be produced.

Figure 9:
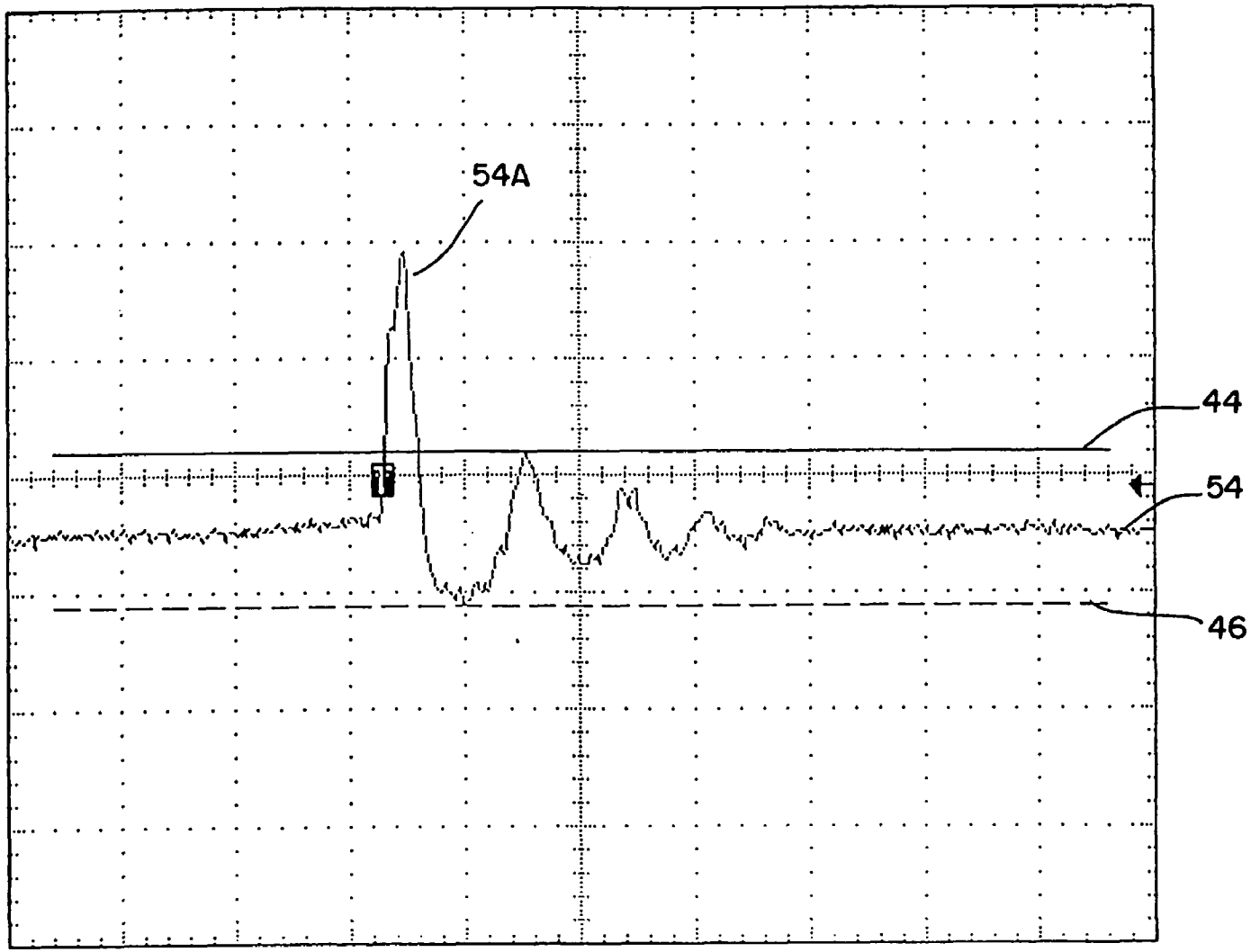

FIG. 9 illustrates a waveform 54 that may be generated as a result of the baton bouncing when set down on a table or other surface. A section 54A of the waveform 54 extends beyond the minimum threshold 44, but for less than a predetermined minimum amount of time. Thus, a signal is not transmitted by the baton 12 as a result of this waveform since the waveform is determined to be the result of incidental baton movement.

Figure 10:
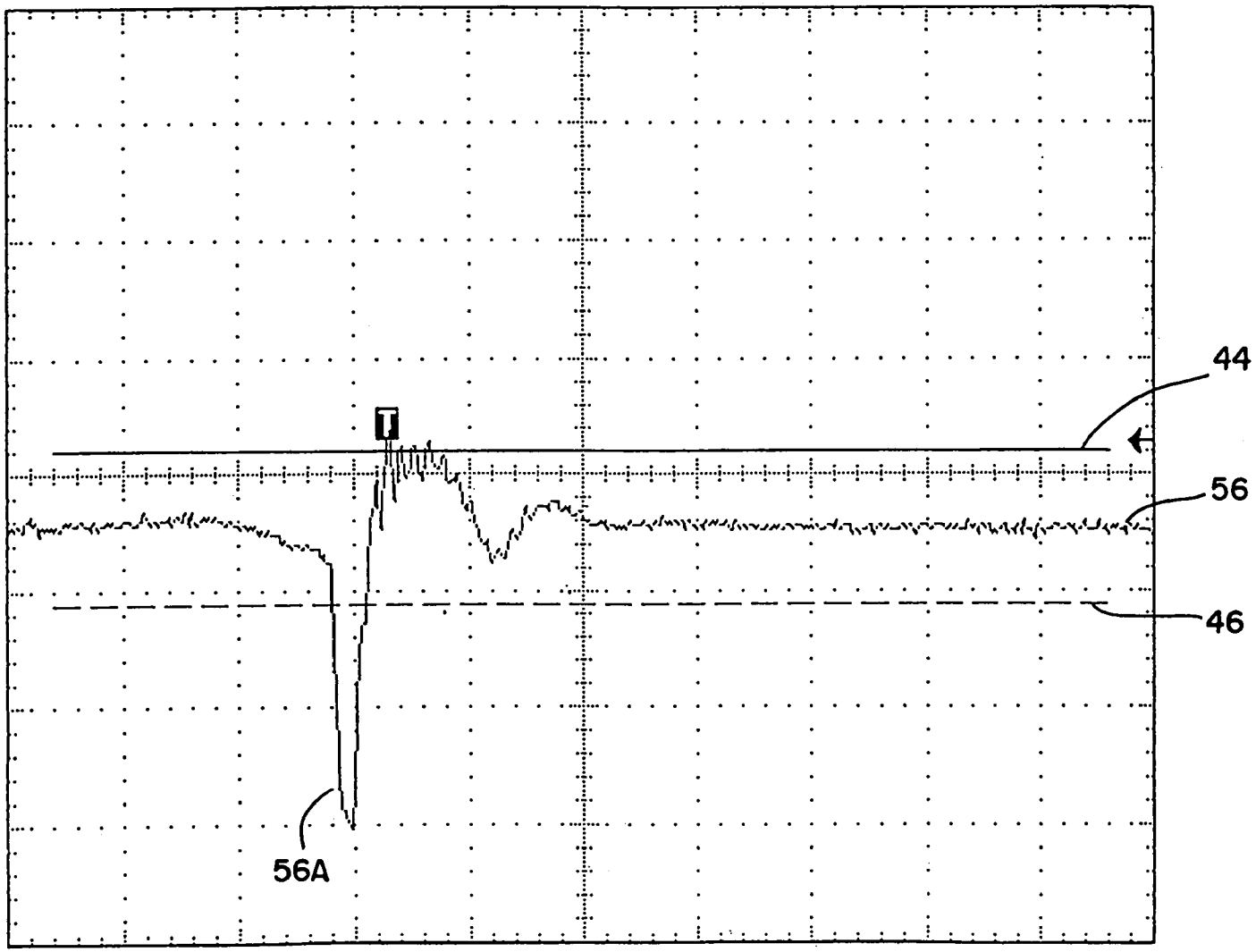

FIG. 10 illustrates a waveform 56 that is generated, for example, when the baton 12 is rapidly moved in a direction opposite to that shown by arrow "E" in FIG. 2 and is tapped against a surface, such as the shoulder of the player. The waveform 56 includes a section 56A that extends beyond the lower, or negative, threshold 46 for less than a minimum amount of time, for instance, less than 25 milliseconds. This spiked-shaped waveform section 56A is of opposite polarity relative to sections 48A and 50A of waveforms 48 and 50 that produce play signals. Thus, waveform 56 is clearly distinguishable from the other waveforms, 42, 48, 50, 52 and 54 and can be used to cause a mute, or quench, signal to be transmitted by the baton 12. A mute, or quench, signal may be desired to damp a played sound, for instance, similar to when a handbell player damps the vibrations of a ringing bell by grasping the ringing bell.

Thus, as described in detail above, the oscillating waveforms produced by the piezoelectric reed 40 enable the baton 12 according to the present invention to readily distinguish between incidental movements of the baton 12 (ie., general handling or side-to-side movements) and movements intended to cause a play or mute signal to be transmitted by the baton 12.

Preferably, the baton 12 includes visible indicia means carried on the housing 24 for providing the user with information on proper orientation of the baton 12 and its desired plane of movement. For example, as illustrated in FIG. 2, the front side 58 of the baton 12 includes a label mounting area, or thumb rest, 60 that identifies the gripping end 26 of the baton 12 and the proper orientation of the baton 12 during movement thereof. For example, a play signal is transmitted by the baton 12 when the user grips end portion 26 and rapidly moves the baton in a plane of movement as indicated by arrow "E" in FIG. 2 to a first free position. A mute signal is transmitted when the baton 12 is moved to a second surface engaging position such as being tapped on the user's shoulder or on a padded surface of a table or the like.

As discussed above, the batons 12 form a part of an electronic tone generation system 10 as illustrated in FIG. 1. To this end, the system 10 includes a plurality of separate handheld batons 12 each capable of separate wireless communication with the receiver 16. Each baton 12 has a unique identification code and each transmission 14 by a baton 12 includes information concerning the identification code so that the system 10 can determine which baton is transmitting a particular signal 14. Preferably, each baton 12 includes an address selector 34, such as a set of DIP switches, for setting and permitting re-setting of the identification code of the baton 12. Thus, each transmission 14 includes at least information concerning the identification code of the baton 12 and the relative volume level of the sound to be produced (volume level is zero for a mute signal).

In the event that two or more batons 12 of the system 10 attempt to transmit a signal 14 simultaneously, each baton 12 operates in a "listen before speak" mode to avoid interference between transmitted signals 14. To this end, the transceiver 38 of each baton 12 is capable of receiving signals 14 transmitted by other batons including information concerning the identification code of the transmitting baton. Thus, before a baton 12 transmits a signal to the receiver 16, it first listens for signals 14 currently being transmitted from another baton and, if a signal 14 is received by the transceiver 38, the microprocessor 36 calculates a time delay before its signal 14 is transmitted to the receiver 16. For example, if baton ID code number twelve transmits a signal, and baton ID code twenty is simultaneously instructed to transmit a signal, the microprocessor 32 of the baton ID code twenty listens to the signal 14 from baton ID code number twelve and determines the necessary time delay for baton ID code numbers thirteen to nineteen to transmit before baton ID code twenty transmits.

The receiver 16 and control logic 18 according to the present invention preferably generate a MIDI output signal that can be input into any MIDI tone generator. Thus, the system 10 according to the present invention can include a tone generator or can be designed to be used with an existing MIDI tone generator.

MIDI tone generators typically permit thousands of sounds, or voices, to be generated including sounds of musical instruments as wells sounds, such as, a dog barking, a crashing noise, a person's voice, etc. Thus, the receiver 16 includes controls that enable the voice produced by each baton to be selected from thousands of voices and at different notes' or chords. For example, each baton can play the same voice, such as the sound of an oboe, or a selected number of batons can produce one voice, such as handbell sounds, and another selected number of batons can produce a different voice, such as drum sounds. Of course, any variation, including number, type, and pitch, note or chords of voices and/or number of batons, is possible.

The receiver 16 also includes controls with respect to volume level, transposition, and pre-set storage and recall of various voice, note of voice, and volume settings. To this end, the receiver 16 utilizes the unique identification code of each baton to control the sound caused to be produced by the baton and can track which batons are in operation and which batons are inactive. If a particular baton is out-of-service, the receiver can be set to permit another baton having a different identification code to take the place of the out-of-service baton.

Another feature of the present invention is that each baton carries a rechargeable battery 62 in the end portion 26 of the housing 24 and has a recharging port 64 adjacent the battery 62. Preferably, the batons 12 are powered by rechargeable NiMh batteries, and the baton housing 24 carries a visible light source, such as an LED light source, 66 remote from the end portion 26 to indicate the level of charge of the battery 62. Preferably, the carrying or storage case of the batons has a charging stand for supporting a plurality of batons upright in rows and enables the level of charge of individual batons to be determined visually at a glance. To this end, the batons are oriented such that the recharging ports 64 face downward within the charging stand, and the LED light sources 66 face upward and are visible.

While a preferred baton and electronic tone generation system has been described in detail, various modifications, alterations, and changes may be made without departing from the spirit and scope of the baton and electronic tone generation system according to the present invention as defined in the appended claims.

What is claimed is:

1. A baton for cooperation with an electronic tone generation system to produce different audible sounds in response to different movements of the baton, comprising:

a housing having an end portion grippable by a user's hand for movement in a plane between at least a first free position and a second position;

a motion sensor carried in said housing a spaced distance from said end portion for producing an electromagnetic signal in response to said movements; and a signal processor carried in said housing for cooperating with said motion sensor to produce a transmittable play signal corresponding to movement of the baton to said first position and a transmittable mute signal corresponding to movement to said second position;

said transmittable play signal corresponding to a sound made by a musical instrument, and said transmittable mute signal corresponding to a sound made by a musical instrument when muted;

whereby the user is able to produce either full or muted sounds by moving the baton between said first and second positions.

2. A baton according to claim 1, wherein said motion sensor and signal processor cooperate to permit the baton to produce a transmittable play signal only when said baton is moved substantially in said plane of movement.

3. A baton according to claim 2, wherein said motion sensor includes a piezoelectric reed which is mounted in said housing to flex about an axis transverse to said plane of movement.

4. A baton according to claim 3, wherein said baton includes visible indicia means carried on said housing for providing the user with information on the proper orientation of the baton with its desired plane of movement.

5. A baton according to claim 1, wherein said baton carries a rechargeable battery in said housing end portion and a recharging port adjacent said battery.

6. A baton according to claim 5, wherein said baton housing carries a visible light source remote from said end portion to indicate the level of charge of said battery.

7. A baton according to claim 6, including a charging stand for supporting a plurality of said batons upright in rows to enable the level of charge of individual batons in said plurality to be determined visually at a glance.

8. A baton for cooperation with an electronic tone generation system to produce different audible sounds in response to different movements of the baton, comprising:

a housing having an end portion grippable by a user's hand for movement in a plane between at least a first free position and a second surface engaging position;

a motion sensor carried in said housing a spaced distance from said end portion for producing an electromagnetic signal in response to said movements, said motion sensor being a piezoelectric reed mounted in said housing to flex about an axis transverse to said plane of movement;

a signal processor carried in said housing for cooperating with said motion sensor to produce a transmittable play signal corresponding to movement of the baton to said first position and a transmittable mute signal corresponding to movement to said second position, said motion sensor and signal processor cooperating to permit the baton to produce said transmittable play signal only when said baton is moved substantially in said plane of movement; and visible indicia carried on said housing for providing the user with information on proper orientation of the baton with its desired plane of movement;

said transmittable play signal corresponds to a sound made by a musical instrument, and said transmittable mute signal corresponds to a sound made by a musical instrument when muted;

whereby the user is able to produce either full or muted sounds by moving the baton between said first and second positions.

9. A wireless handheld baton for communicating with a receiver of an electronic tone generation system that produces audible sounds in response to movements of the baton, comprising:

a housing having a grippable end portion;

a motion sensor carried in said housing a spaced distance from said end portion for generating an electromagnetic waveform signal in response to movements of the baton, said motion sensor generating waveforms of different shapes that are produced as a function of baton orientation and direction of movement; and a signal processor and transmitter carried in said housing for receiving said electromagnetic waveform signal from said motion sensor and for selectively transmitting a wireless electromagnetic signal from the baton to the receiver of the electronic tone generation system to produce an audible sound only when said electromagnetic waveform signal is within a predetermined range of waveform shapes, said produced audible sound corresponding to a sound made by a musical instrument;

said transmitter also being adapted to transmit a mute signal to the receiver to alter said audible sound to that corresponding to a sound made by a musical instrument when muted.

10. A baton according to claim 9, wherein said motion sensor generates electromagnetic waveform signals having alternating polarity.

11. A baton according to claim 9, wherein said motion sensor is a piezoelectric reed that flexes in forward and rearward directions about an axis within said housing.

12. A baton according to claim 11, wherein said piezoelectric reed generates an electromagnetic waveform signal that is within said predetermined range of waveform shapes only when said baton is moved in a plane of movement transverse to said axis of said piezoelectric reed.

13. A baton according to claim 11, wherein said piezoelectric reed generates an electromagnetic waveform signal that is within said predetermined range of waveform shapes only when said baton is moved in a plane of movement substantially perpendicular to said axis of said piezoelectric reed.

14. A baton according to claim 13, wherein said baton includes indicia at a predetermined location on said housing for providing information with respect to proper orientation of the baton within said plane of movement, and wherein said piezoelectric reed generates an electromagnetic waveform signal that is within said predetermined range of waveform shapes only when said baton is moved in said plane of movement with said baton in said proper orientation.

15. A baton according to claim 11, wherein said predetermined range of waveform shapes includes a waveform with alternating polarity that includes a section extending beyond a first minimum threshold value for greater than a predetermined period of time.

16. A baton according to claim 15, wherein said amplitude of said section of said waveform determines a relative volume level of the audible sound produced in response to movement of the baton.

17. A baton according to claim 15, wherein said first minimum threshold value has a predetermined polarity.

18. A baton according to claim 17, wherein said transmitter transmits said mute signal when said electromagnetic waveform signal includes a section that extends beyond a second predefined minimum threshold value for less than a predetermined period of time, said second predefined minimum threshold value being of opposite polarity relative to said first minimum threshold value.

19. An electronic tone generation system, comprising:

a plurality of separate handheld batons each capable of wireless communication with a receiver that generates an output signal;

said batons each having a housing with a grippable end portion and a motion sensor carried in said housing a spaced distance from said end portion, said motion sensor generating an electromagnetic waveform signal having alternating polarity in response to movements of the baton, said motion sensor generating different waveforms depending upon baton orientation and direction of movement; and said batons each having a signal processor and transmitter carried in said housing for receiving said electromagnetic waveform signal from said motion sensor and for selectively effecting said wireless transmission to said receiver to produce an audible sound only when a section of said electromagnetic waveform signal has a predetermined polarity and extends above a first threshold value for at least a predetermined period of time, said produced audible sound corresponding to a sound made by a musical instrument;

each of said transmitters also being adapted to transmit a mute signal to the receiver to alter said audible sound to that corresponding to a sound made by a musical instrument when muted.

20. An electronic tone generation system according to claim 19, wherein said motion sensor of each of said batons is a piezoelectric reed that flexes about an axis, and wherein a section of said electromagnetic waveform signal that has said predetermined polarity and that extends above said first threshold value for at least said predetermined period of time is obtained only when said baton is moved in a plane of movement substantially perpendicular to said axis of said piezoelectric reed.

21. An electronic tone generation system according to claim 20, wherein said housing of each of said batons includes indicia on a predetermined location thereof for providing information with respect to proper orientation of the baton within said plane of movement, and wherein a section of said electromagnetic waveform signal that has said predetermined polarity and that extends above said first threshold value for at least said predetermined period of time is obtained only when said baton is moved in said plane of movement with said baton in said proper orientation.

22. An electronic tone generation system according to claim 19, wherein said transmitter transmits said mute signal when said electromagnetic waveform signal includes a section that extends beyond a second predefined minimum threshold value for less than a predetermined period of time, said second predefined minimum threshold value being of opposite polarity relative to said first threshold value.

23. An electronic tone generation system according to claim 19, wherein each baton has a unique identification code, and wherein each transmitter includes information concerning said identification code of said baton in each wireless transmission.

24. An electronic tone generation system according to claim 23, wherein each baton includes a set of DIP switches for setting said identification code.

25. An electronic tone generation system according to claim 23, wherein each baton has a microprocessor, wherein said transmitter of each baton is a transceiver that enables said transmitter to operate in a "listen before speak" mode to avoid interference with other transmitters, and wherein, when a wireless transmission is received by said transceiver during said listen before speak mode, a delay time for transmitting a wireless transmission is determined by said microprocessor as a function of the identification code of said received transmission.

26. An electronic tone generation system according to claim 19, wherein said output signal generated by said receiver is a MIDI output signal.

27. An electronic tone generation system according to claim 19, further comprising a MIDI tone generator, amplifier and at least one speaker for producing an audible sound from said MIDI output signal.

28. An electronic tone generation system according to claim 19, wherein different batons are capable of being pre-set to produce different audible sounds.

* * * * *